US007617934B2

(12) United States Patent
Taguchi et al.

(10) Patent No.: US 7,617,934 B2
(45) Date of Patent: Nov. 17, 2009

(54) ALKYL IODIDE STORAGE CONTAINER AND METHOD FOR PURIFICATION OF ALKYL IODIDE

(75) Inventors: Nobuhiro Taguchi, Chiba (JP); Makoto Takahashi, Chiba (JP)

(73) Assignee: Nippoh Chemicals Co., Ltd., Tokyo (JP)

( * ) Notice: Subject to any disclaimer, the term of this patent is extended or adjusted under 35 U.S.C. 154(b) by 767 days.

(21) Appl. No.: 10/869,452

(22) Filed: Jun. 15, 2004

(65) Prior Publication Data

US 2005/0000846 A1 Jan. 6, 2005

(30) Foreign Application Priority Data

Jul. 2, 2003 (JP) ..... 2003-270471

(51) Int. Cl.
*B65D 85/84* (2006.01)
*B01D 53/68* (2006.01)

(52) U.S. Cl. ..... 206/524.4; 206/524.1; 423/240 R

(58) Field of Classification Search ..... 206/0.6, 206/0.7, 524.1, 524.3, 524.4; 423/240, 241, 423/240 R, 240 S
See application file for complete search history.

(56) References Cited

U.S. PATENT DOCUMENTS 3,018,159 A * 1/1962 Silverman ..... 423/241
3,024,847 A * 3/1962 Vaughn ..... 169/72
3,429,655 A * 2/1969 Case ..... 423/241
4,036,402 A * 7/1977 Taylor ..... 222/1
4,064,022 A * 12/1977 Kawasaki et al. ..... 205/572
4,312,647 A * 1/1982 Tsuchiya et al. ..... 96/134
5,736,915 A * 4/1998 Goedde et al. ..... 336/55
5,962,735 A * 10/1999 Kulprathipanja et al. .... 562/608
6,152,741 A * 11/2000 Hirata ..... 434/301

OTHER PUBLICATIONS

First Office Action issued Sep. 7, 2007 by the State Intellectual Property Office of China in corresponding application Chinese Patent Application No. 200410071467.1.

Lodewijk, Ijlst, New Diluents in Heavy Liquid Mineral Seperation and an Improved Method for the Recovery of the Liquids from the Washings, American Minerologist, vol. 58, pp. 1084-1087, 1973.

* cited by examiner

*Primary Examiner*—J. Gregory Pickett
(74) *Attorney, Agent, or Firm*—Porzio, Bromberg & Newman, P.C.

(57) ABSTRACT

A storage container for alkyl iodide comprising a stabilizing material for an alkyl iodide being disposed inside the container so as to contact an alkyl iodide liquid and an alkyl iodide gas is provided. By disposing the stabilizing material, it represses the decomposition of the alkyl iodide of both the liquid phase and the gas phase and generation of iodine, thereby ensuring the stability of the alkyl iodide itself.

6 Claims, 3 Drawing Sheets

ALKYL IODIDE STORAGE CONTAINER AND METHOD FOR PURIFICATION OF ALKYL IODIDE

BACKGROUND OF THE INVENTION

1. Field of the Invention

This invention relates to an alkyl iodide storage container which uses in the contact surface between the alkyl iodide liquid and gas inside the container a stabilizing material for repressing decomposition of the alkyl iodide, thereby preventing the container from corrosion and enabling the alkyl iodide to be stably stored for a long time without incurring deterioration and to a method for purifying an alkyl iodide by the use of this storage container.

2. Description of the Related Art

Alkyl halides are compounds in extensive industrial use for raw materials of chemical products, solvents, and fumigants. Methyl iodide which has one carbon atom, for example, has a low boiling point and is used as fumigants for soil, timbers, agricultural produces, buildings, structures, and cultural assets and can exist in a gaseous state at room temperature. The alkyl halides, depending on the kind of alkyl group, may exist in a liquid state at room temperature. The containers used for storing the alkyl halides, therefore, come in various types to suit such varying states of existence. Particularly, some of the alkyl halides are used as fumigants as described above and they possess no insignificant toxicity. Thus, pressure-resistance containers or cylinders made of glass or high pressure-resistance containers or cylinders made of metal or normal pressure metallic containers are being used to avoid leakage of such alky halides during the course of storage and transportation.

It is well known that alkyl iodide can release iodine when it is exposed to such factors as even slight light and the state of storage. For example, the alkyl iodide (RI) (wherein R denotes an alkyl group) reacts with water and generates iodine ($I_2$) and an alcohol (ROH). The iodine is a dark brown gaseous substance and, when suffered to dissolve in the alkyl iodide, causes coloration to the product. The inclusion of free iodine in the alkyl iodide results in not only deteriorating the product itself but also inducing corrosion of the metals used in the container and the vaporizer, and further causing leakage through the container by penetration and inflicting unexpected toxic harm on the substance being fumigated. The prevention of the alkyl iodide from being deteriorated during the course of storage and/or transportation thereof in the container and the protection of the container itself, therefore, have been promoted as by furnishing the container with a packing made as of polytetrafluoroethylene which is capable of preventing leakage of the generated iodine thereby ensuring air tight of the container, lining inside the container with polytetrafluoroethylene in order to prevent metallic parts of the container from the corrosion by the iodine, and placing such a stabilizing agent as hypo water in the container to trap the generated iodine.

Even if a container which is provided at the design stage with sufficient corrosion-resistant and airtightness is put to use, more often than not the iodine generated in consequence of decomposition corrodes the container structured with the metal, or promotes deterioration of the packings, and ultimately leaks from the container and deprives of the container of its airtightness. As reasons for this decomposition of the alkyl iodide, the light and the heat during the alkyl iodide is introduced into the container or during its storage in the container and the oxide adhered to the inner wall surface of the container may be cited. Since perfect elimination of these causes is next to impossible, the causes results in the service life of the container being shortened.

The method for coating a polytetrafluoroethylene on the inner wall surface of the container entails the difficulty in cleaning the interior of the container because the container of a closed structure. Even the addition of such a stabilizing agent as a radical scavenger or a hypo water fails to manifest their effect fully satisfactorily when corrosion occurs in the gas phase. Further, the addition of the stabilizing agent, depending on the purpose of use, is possibly at a disadvantage in lowering the purity of the alkyl iodide.

SUMMARY OF THE INVENTION

The present inventors have found the fact that metallic copper, metallic silver, alloys of copper and silver, etc. possess high affinity for iodine and that when at least one member selected from the group consisting of metallic copper, metallic silver, and alloys of copper and silver as a stabilizer is contacted to the liquid and the gas of an alkyl iodide during the storage and the transportation of the alkyl iodide, the corrosion of the container itself can be repressed, and finally establish the present invention.

When the alkyl iodide is stored in the container of this invention, it can be prevented from decomposition during the storage and transportation thereof. Even when the product has been already colored in consequence of the generation of iodine by decomposition, the use of the storage container permits removal of iodine inside the storage container. Therefore, the alkyl iodide product in the storage container is purified till thorough loss of color. The problems mentioned above are solved by the following items.

(1) A storage container for alkyl iodide, wherein a contact surface of the container with an alkyl iodide liquid and a contact surface of the container with an alkyl iodide gas are formed of a stabilizing material for the alkyl iodide.

(2) A storage container for alkyl iodide, which comprises a stabilizing material for an alkyl iodide to be disposed inside the container so as to contact an alkyl iodide liquid and an alkyl iodide gas.

(3) A storage container for alkyl iodide according to item (1), wherein the stabilizing material is at least one member selected from the group consisting of metallic copper, metallic silver, an alloy of copper and silver, and a complex metal of copper and silver.

(4) A storage container for alkyl iodide according to item (1), wherein a part of the stabilizing material contacted with an alkyl iodide liquid and a part of the stabilizing material contacted with an alkyl iodide gas are formed of different members.

(5) A storage container for alkyl iodide according to item (1), wherein the stabilizing material contacted with an alkyl iodide liquid and the stabilizing material contacted with an alkyl iodide gas are disposed inside the container and the both stabilizing materials are formed of different members.

(6) A storage container for alkyl iodide according to item (1), wherein the alkyl iodide is at least one member selected from the group consisting of methyl iodide, ethyl iodide, propyl iodide, isopropyl iodide, and butyl iodide.

(7) A method for purifying an alkyl iodide, by storing an alkyl iodide in an alkyl iodine storage container set forth in any of items (1)-(5) and causing the iodine generated by the decomposition of the alkyl iodide to react with the alkyl iodide stabilizing material.

According to the present invention, the alkyl iodide which has been heretofore liable to induce deterioration such as coloration and consequently entail such problems as corrosion of the container thereof and to defy safe preservation thereof can be stably preserved for a long time.

DESCRIPTION OF THE PREFERRED EMBODIMENT(S)

Figure 1:
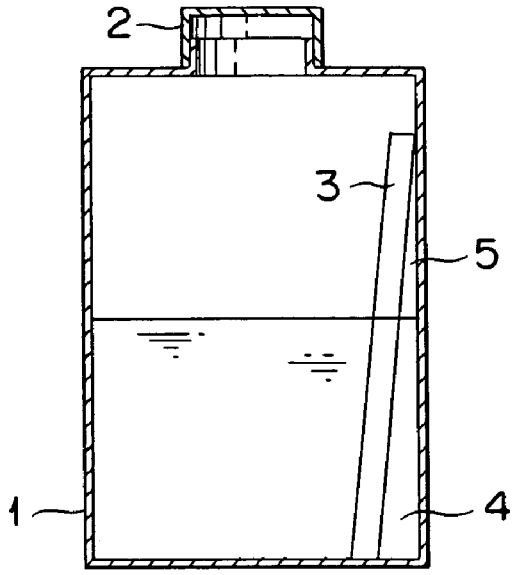
FIG. 1 is a diagram illustrating a cylindrical storage container of this invention provided in the upper part thereof with an alkyl iodide inlet-outlet port, which is disposed therein a stabilizing material so that the material is contact to both of gas phase and liquid phase of alkyl iodine.

The first aspect of this invention is directed toward a storage container for alkyl iodide, wherein a contact surface of the container with an alkyl iodide liquid and a contact surface of the container with an alkyl iodide gas are formed of a stabilizing material for the alkyl iodide.

The alkyl iodide possesses an alkyl group of 1 to 8, preferably 1 to 6, carbon atoms. Particularly, one member or more selected from the group consisting of methyl iodide, ethyl iodide, propyl iodide, isopropyl iodide, and butyl iodide is preferable. All the alkyl iodides can release iodine by decomposing and consequently suffer with coloration of the relevant product and corrosion of the container. It causes in a gaseous state or a liquid state at room temperature, depending on the number of carbon atoms in the alkyl group. When the storage container is made in a pressure-resistance structure, the gaseous alkyl iodide can be stored under pressure.

The shape of the storage container of this invention does not need to be particularly restricted but is only required to be provided at least with an inlet-outlet port for the alkyl iodide so as to permit storage of the alkyl iodide therein. The outer shape of the storage container may be selected arbitrarily from among cubes, spheres, cones, polygonal cones, cylinders, polygonal columns, and the like. The conventional well-known shapes such as those of gas cylinders and fire extinguishers which are circular columns having upper and lower parts curved slightly hemispherically are also available. The shape itself may be properly selected so as to suit the amount of the alkyl iodide to be stored. The shape of a drum may be adapted for storing the alkyl iodide in a large volume and the shape of a gas cylinder for storing it in an intermediate amount.

The material for the container is preferred to avoid reacting with the alkyl iodide, ensure retention of airtightness, and excel in resistance to pressure. Glass, iron, alloys of iron such as stainless steel are favorably available, depending on the capacity of the storage container.

The storage container of this invention is characterized by the fact that surfaces of the interior of the container which contact the alkyl iodide liquid and the alkyl iodide gas respectively are formed of a stabilizing material for the alkyl iodide. When the stabilizing material is used only on the surface which contacts the alkyl iodide liquid, the decomposition on the liquid phase side of the alkyl iodide is repressed. The gas phase, however, actually contains the water component which promotes the decomposition of the alkyl iodide and yields to the influence of light and heat as well. The iodine which is generated by the decomposition caused by the water component in the ambient air entrained into the container with the alkyl iodide during the course of the introduction persists in the gas phase. In this invention, by repressing the decomposition of both the liquid and the gas of alkyl iodide and the generation of iodine, it is made possible to prevent the corrosion induced in the gas phase of the container and the deterioration of the packing for airtightness which have been hitherto posing problems.

The stabilizing material for the alkyl iodide is at least one member selected from the group consisting of metallic copper, metallic silver, alloys of copper and silver, and complex metals of copper and silver. The ratio of copper and silver in the alloy and in the complex metal does not need to be specified. The components may be mutually added in amounts each in the range of 0 to 100 wt %. The term "alloy" means a homogeneous substance resulting from fusing two or more species of metal and the term "complex metal" means a substance resulting from mixing silver particles and copper particles and not forming a homogeneous composition.

As respects the shape of the stabilizing material, nets, cords, chains, plates, foils, tubes, and grains of the material, cubes and spheres obtained by forming the plates, and hollow spheres of the material are conceivable. The shape is preferred to have a large surface area in consideration of the efficiency of contact with the alkyl iodide. The stabilizing material in a granular form may be used provided that they are in a net pouch of stainless steel to prevent possible dispersion of the grains within the container, or they are molding into beads and concatenated into a chain.

As the surface which contact to the alkyl iodide includes the inner wall surface of the container, and various members which are disposed inside the container. When the container incorporates the siphon tube part of a pump for the purpose of scooping the content, for example, the siphon may be included.

This invention allows the alkyl iodide stabilizing material to be disposed in the container other than a contact surface of the container is formed of the stabilizing material. When the storage container is packed with the alkyl iodide, the case which the stabilizing material is disposed inside the container so that the material is enabled to contact both the gas and the liquid of alkyl iodide may be cited as a preferred embodiment of this invention. That is, this invention only requires that the stabilizing material it contacted to liquid phase and gas phase of the alkyl iodide inside a container. Therefore, it does not need to be limited to the case that the container is formed of the alkyl iodide stabilizing material, but may be permitted in any of the modes which are capable of contacting the stabilizing material with the liquid and gas phase of the alkyl iodide. The invention may use two or more the stabilizing material, for example, even by having the stabilizing materials sedimented in or suspended on the alkyl iodide stored in the container and allowing the to contact the alkyl iodide liquid and the alkyl iodide gas respectively. Now, one preferred embodiment of the stored container contemplated by this invention will be described below with reference to the accompanying drawing.

FIG. 1 is a diagram illustrating a cylindrical storage container of this invention provided in the upper part thereof with an alkyl iodide inlet-outlet port, which is disposed therein a stabilizing material so that the material is contact to both of gas phase and liquid phase of alkyl iodine. With reference to the diagram, 1 denotes an outer cylinder of container, 2 a lidpart, 3 an alkyl iodide stabilizing material, 4 the liquid phase of alkyl iodide stored in the container, and 5 the gas phase. An alkyl iodide inlet-outlet port not shown and the lid part are retained airtightly with a packing.

The container of this invention has disposed inside the container 1 the alkyl iodide stabilizing material 3 which is formed of a copper plate. Since the alkyl iodide has generally high reactivity, it is packed in the container in the environment isolated from light and moisture with a view to preventing the entry of the ambient air into the container during the course of filling the container with the alkyl iodide. When the alkyl iodide happens to be methyl iodide having a low boiling point, for example, the packing is carried out under pressure. After the packing is completed, the gas of methyl iodide fills the inner space of the container on the liquid. The storage container of this invention, in consideration of the mode of introduction of the alkyl iodide is so constructed that when the container is filled with the alkyl iodide, the alkyl iodide and the alkyl iodide stabilizing material may contact mutually. The alkyl iodide is caused by oxidation, light, and heat to generate iodine and this iodine forms the cause for the corrosion of the container. According to this invention, by having the stabilizing material duly disposed, it is made possible to repress efficiently the decomposition of the alkyl iodide and prevent the corrosion.

As concrete examples of the alkyl iodide stabilizing material to be used in this invention, metallic copper, metallic silver, alloys of copper and silver, and complex metals of copper and silver may be cited. Since the stabilizing material has high affinity for iodine, it readily forms an iodide and promptly gives rise to a reaction product insoluble in the alkyl iodide. Therefore the iodine gas which is generated during the course of decomposition can not be released into the gas phase and cannot be solved into the liquid phase. Thus, the stabilizing material efficiently prevents the container from corrosion.

For the sake of the contact between the alkyl iodide stabilizing material 3 and the alkyl iodide, it is proper to have the stabilizing material so disposed as to contact both the surfaces of the liquid phase 4 and the gas phase 5 of the alkyl iodine. Since there action of the decomposition of the alkyl iodide occurs not only in the liquid phase but also in the gas phase, the alkyl iodide stabilizing material so disposed as to contact the gas phase as well is enabled to act synergistically with the effect of repressing the decompression. In this respect, the conventional stabilizing material such as radical scavenger or a hypo water is supposed to be disposed in the liquid phase and therefore is capable of repressing the decomposition of the alkyl iodide in the liquid phase, it encounters difficulty in repressing the decomposition in the gas phase. The gas phase, however, contains the water component which promotes the decomposition of the alkyl iodide. The gas phase is prone to the influences of light and heat. The water component in the ambient air which enters the container while the container is being filled with the alkyl iodide and the iodine generated by decomposition are suffered to persist in the gas phase. Further, the generated iodine catalytically acts in the reaction of metal oxide and promotes the deterioration of the container conspicuously. When the alkyl iodide stabilizing material 3 is disposed in the gas phase as well, it synergistically acts with the repression of the decomposition of the alkyl iodine in the liquid phase to prevent the decomposition highly efficiently and repress the generation of the iodine in the gas phase and the liquid phase of the alkyl iodide stored in the container. Thus, the corrosion occurring in the gas phase part of the container and the deterioration of the packing in the stopper which have been posing problems can be prevented.

Figure 2:
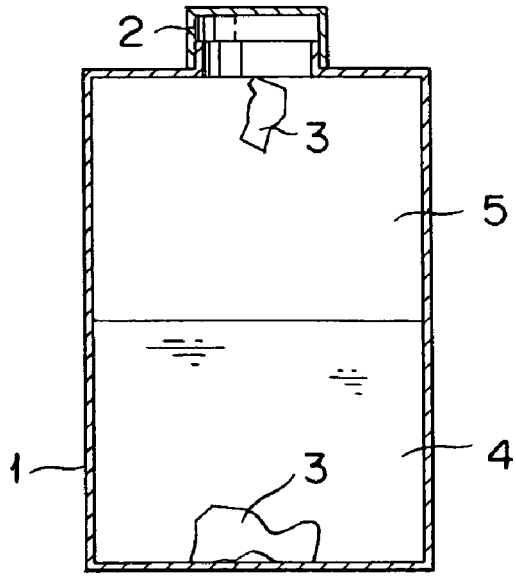
FIG. 2 is a diagram illustrating the mode that the stabilizing material for the alkyl iodides are disposed in gas phase and liquid phase of alkyl iodine in a cylindrical storage container of this invention so that the materials are contacted to the both phases.

FIG. 2 illustrates the mode of having the alkyl iodide stabilizing material 3 disposed independently in the liquid phase 4 and the gas phase 5. The alkyl iodide stabilizing material 3 disposed in the liquid phase 4, when retained inside the container, is precipitated in the liquid phase and consequently keep contacting with the alkyl iodide during the course of use without reference to the amount of the residual alkyl iodide. The disposition of the alkyl iodide stabilizing material 3 in the gas phase is attained by fixing the plate-shaped metallic copper as with a hook.

Figure 3:
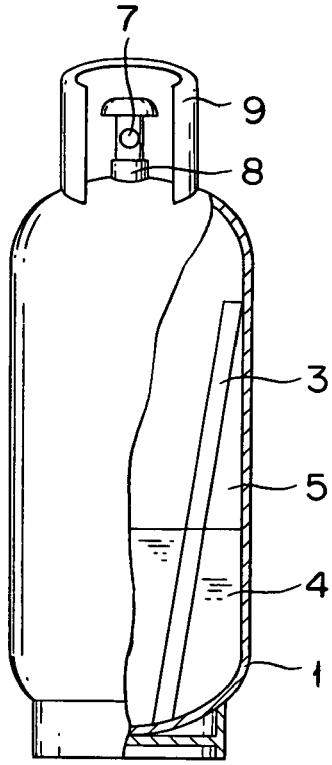
FIG. 3 is a partial cross section illustrating one example of a pressure-resistance storage container of this invention, which is disposed therein a stabilizing material so that the material is contact to both of gas phase and liquid phase of alkyl iodine.

FIG. 3 is a partial cross section illustrating one example of the pressure storage container. In the diagram, 1 denotes the outer cylinder of a container, 3 an alkyl iodide stabilizing material, 4 an alkyl iodide stored in the container, 7 a valve, 8 a valve joint, and 9 a protective cap. When the container has been filled with the alkyl iodide and then pressed as with an inert gas, the alkyl iodide can be extracted from the container by means of a siphon tube. The pressure storage container of this construction can be prevented from the corrosion due to the decomposition of the alkyl iodide by having the alkyl iodide 3 formed in the shape of a bar with metallic copper inserted into the container 3. When the alkyl iodide stabilizing material 3 is formed in a continuous length, it can be easily inserted and put to use.

Figure 4:
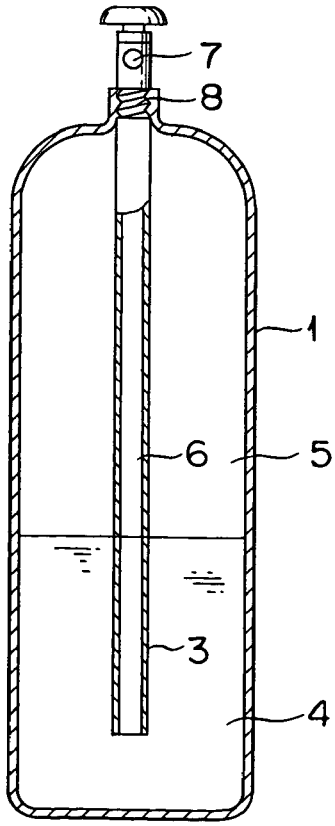
FIG. 4 is a diagram illustrating the mode of a pressure-resistance container having a siphon tube joined to a valve thereof, in which the siphon tube is covered with a stabilizing material for an alkyl iodine.

In another mode of embodying the pressure storage container which has the siphon valve 7 provided with the siphon tube 6 extended to reach the liquid phase 4 in the container, as shown in FIG. 4, a metallic copper or a metallic silver may line the siphon tube 6 or coat the outer periphery of the siphon tube 6 or the siphon tube may be wholly formed of metallic copper, metallic silver, an alloy of copper and silver, or a complex metal of copper and silver.

Figure 5:
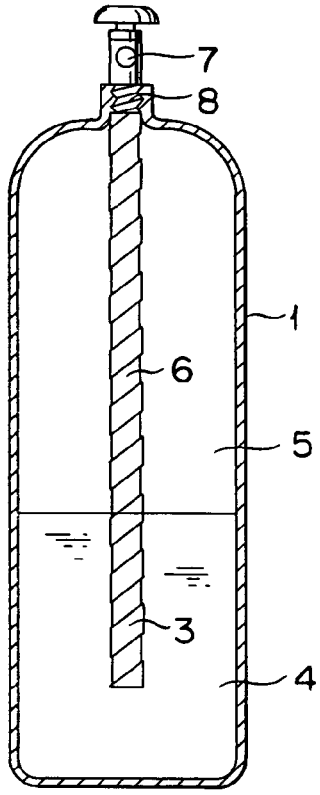
FIG. 5 is a diagram illustrating the mode of a pressure-resistance container having a siphon tube joined to a valve thereof, in which the siphon tube is wrapped around with a stabilizing material for an alkyl iodine.
Figure 6:
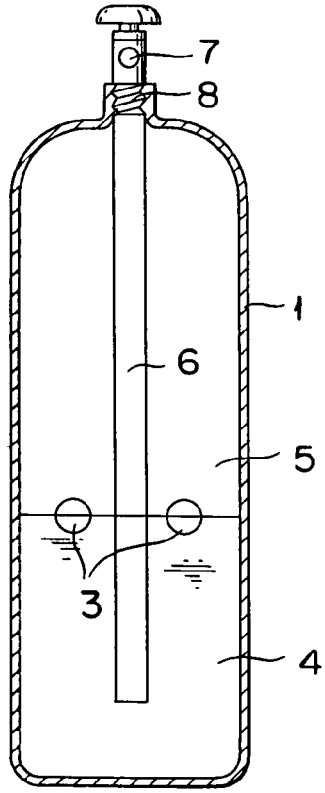
FIG. 6 is a partial cross section illustrating one example of a pressure-resistance storage container of this invention, where a round stabilizing material is floated on liquid phase of alkyl iodine so that it can contact to both of gas phase and liquid phase of alkyl iodine.

This invention may be embodied as in the mode illustrated in FIG. 5 by wrapping a plate of metallic copper, metallic silver, an alloy of copper and silver, or a complex metal of copper and silver around the siphon tube 6 or, as in the mode illustrated in FIG. 6, by causing the balls of synthetic resin coated with metallic copper, metallic silver, an alloy of copper and silver, or a complex metal of copper and silver to float as an alkyl iodide stabilizing material 3. These modes are both capable of repressing the decomposition of the alkyl iodide in both the gas phase and the liquid phase because the alkyl iodide stabilizing material contacts both the liquid phase part and the gas phase part of the alkyl iodine.

This invention prefers the siphon tube to be in the mode of having the alkyl iodide stabilizing material 3 wrapped around thereon or the siphon tube 6 itself to be formed of the alkyl iodide stabilizing material 3 from the viewpoint of the ease with which the stabilizing material is taken out of the container.

In the case of the stabilizing material formed of metallic copper, metallic silver, or an alloy of copper and silver, after it has been used completely, it may be taken out of the container and reclaimed by removing an iodine compound formed on the surface thereof by polishing or acid treatment.

The amount of the alkyl iodide stabilizing material to be used in the storage container of this invention does not need to be particularly restricted but may be properly selected to suit the amount of the iodine contained as a decomposition product. This amount in terms of surface area properly falls in the range of 0.5 to 9 $cm^2$, preferably in the range of 1 to 3 $cm^2$, per 1 liter of the alkyl iodide to be contained. So long as the surface area of the stabilizing material falls in the range mentioned above without reference to the amount of the alkyl iodide at the time of introduction into the container or the amount of the residual alkyl iodide during the course of using, the decomposition of the alkyl iodide can be efficiently repressed. Even when the iodine is generated, it combines with the alkyl iodide stabilizing material and transforms into an insoluble compound and, therefore, cannot solve again in the alkyl iodide. Specifically, the alkyl iodide to be used in this invention is enabled by its own presence to repress the decomposition of the alkyl iodide. When the decomposition product such as iodine is present in the alkyl iodide, the stabilizing material excels in affinity for the alkyl iodide and, therefore, reacts promptly therewith and forms an insoluble iodide and decreases the amount of the iodine in both the gas phase and the liquid phase. Thus, the container is prevented from the corrosion. In the meantime, the stabilizing material reacts with the iodine and transforms into insoluble silver iodide and copper iodide and these insoluble iodides directly adhere to the stabilizing material. When the iodides are deposited on the surface of the stabilizing material to the extent of rendering the reaction of the stabilizing material with iodine difficult, the defiled stabilizing material can be reclaimed as a stabilizing material by removing the adhering iodine physically or chemically.

The container of this invention is efficiently enabled to prevent the deterioration of the alkyl iodide during the storage and transportation thereof and protect the main body of the container as well by having the convenient and effective stabilizing material disposed in the liquid phase and the gas phase inside the container adapted for preservation and transportation.

The second aspect of this invention is directed toward a method for purifying an alkyl iodide, by storing an alkyl iodide in an alkyl iodine storage container set forth in any of claims 1-5 and causing the iodine generated by the decomposition of the alkyl iodide to react with the alkyl iodide stabilizing material.

When the alkyl iodide is stored in the storage container according to the first aspect of this invention, the alkyl iodide in a colorless state can be withdrawn from the container after the elapse of one week to one month from the time of entry therein even if the alkyl iodide happens to be decomposed as by exposure to light during the course of the entry. This storage of the alkyl iodide in this colorless state may be explained by a supposition that the iodine generated by the decomposition reacts with the alkyl iodide stabilizing material and consequently transforms into a solid substance insoluble in the alkyl iodide, with the result that the solid substance will be separated from the alkyl iodide liquid and gas.

Particularly when the alkyl iodide stabilizing material is in the form of a plate and the plate is fixed to inside of the container, or the stabilizing material constitutes a siphon tube itself, the possibility of the stabilizing material is never withdrawn together with the alkyl iodide is nil. Thus, the alkyl iodide which has been purified can be extracted without requiring any special step for the separation of the stabilizing material from the iodide.

In accordance with the method of purification contemplated by this invention, when methyl iodide, for example, is used for the purpose of fumigation, the methyl iodide withdrawn in a transparent state can be used as a fumigant and prevented from imparting a color to the substance being fumigated.

EXAMPLES

Now, this invention will be specifically described below with reference to working examples.

Example 1

Cylinders of iron (standard cylinder) measuring 60 cm in height, 20 cm in diameter, and 17 L in inner volume and provided with a siphon tube integral with a screw type valve, and the cylinders having the identical specification and which siphon are further rolled helically with a copper foil measuring 0.1 mm in thickness, 3 cm in width, and 40 cm in length, and the copper foil is fixed at 5 cm from the terminal of the siphon with copper wire of 1 mm in diameter (copper foil-incorporating cylinder) were prepared.

Two standard cylinders and two copper foil-incorporating cylinders were each filled with 20 kg of methyl iodide and adjusted to an inner pressure of 5 $kg/cm^2$ with nitrogen. The four cylinders consequently obtained were stored with the valves thereof directed upwardly in a warehouse for three months.

After the storage, the valves of the cylinders were opened to withdraw the methyl iodide, the parts of methyl iodide stored in the standard cylinders were in a transparent reddish brown color. In contrast, the parts of methyl iodide stored in the copper foil-incorporating cylinders were found to be in the same colorless transparent state as before the storage. The four cylinders were divested of their siphon tubes and were cut in the central parts with a large sander to inspect the interiors thereof. In the standard cylinders, the parts exposed to the methyl iodine liquid were found to form a black (changed to a reddish brown color after standing) rust, the parts exposed to the methyl iodine gas were found to form a blackish brown color (changed to a reddish brown color after standing) rust and the bottom parts were found to be covered with what seemed to be rust. In the copper foil-incorporating cylinders, the corresponding parts showed no marked change and the bottom parts showed no discernible sign of sediment. The parts of the siphon tubes (made of brass) in the standard cylinders were found to have formed a milky white surface coat which seemed to be an iodide.

Example 2

When the 40 kg of methyl iodide stored in each of the two standard cylinders and consequently tarnished to a brown color prepared by Example 1 were joined. New standard cylinders and new copper foil-incorporating cylinders were each filled with 20 kg portion of the joined methyl iodide, adjusted to a prescribed inner pressure with nitrogen, and stored with the valve directed upwardly for one month.

After the storage, the valves of the cylinders were opened to withdraw the methyl iodide. The parts of methyl iodide stored in the standard cylinders showed a still darker transparent reddish brown color than before the storage. The parts of methyl iodide stored in the two copper foil-incorporating cylinders were in the same colorless transparent state as before the storage.

The invention claimed is:

1. A method for purifying an alkyl iodide, comprising the steps of:

storing the alkyl iodide in a storage container comprising a member disposed in said container, said member having a contact surface adapted for submersion in a liquid phase of the alkyl iodide and a contact surface adapted for contacting a gas phase of the alkyl iodide, said member being formed as a plate, bar or tube, said member being formed of a stabilizing material wherein the stabilizing material is at least one member selected from the group consisting of metallic copper, metallic silver, an alloy of copper and silver, and a complex metal of copper and silver and wherein the alkyl iodide is at least one member selected from the group consisting of methyl iodide, ethyl iodide, propyl iodide, isopropyl iodide, and butyl iodide, wherein iodine generated by the decomposition of the alkyl iodide reacts with the stabilizing material.

2. A storage container for alkyl iodide comprising:

a first member disposed in said container in a liquid phase of the alkyl iodide and a second member disposed in said container in a gas phase of the alkyl iodide, said first member and said second member being formed of a stabilizing material wherein the stabilizing material is at least one member selected from the group consisting of metallic copper, metallic silver, an alloy of copper and silver, and a complex metal of copper and silver and wherein the alkyl iodide is at least one member selected from the group consisting of methyl iodide, ethyl iodide, propyl iodide, isopropyl iodide, and butyl iodide.

3. A method for purifying an alkyl iodide, comprising the steps of:

storing the alkyl iodide in said storage container set forth in claim 2 wherein iodine generated by the decomposition of the alkyl iodide reacts with the stabilizing material.

4. A method for purifying an alkyl iodide, comprising the steps of:

storing the alkyl iodide in a storage container comprising a siphon tube extending into said container said siphon tube having a contact surface adapted for contacting a liquid phase of the alkyl iodide and a contact surface adapted for contacting a gas phase of the alkyl iodide, said siphon tube being formed of or coated with a stabilizing material wherein the stabilizing material is at least one member selected from the group consisting of metallic copper, metallic silver, an alloy of copper and silver, and a complex metal of copper and silver and wherein the alkyl iodide is at least one member selected from the group consisting of methyl iodide, ethyl iodide, propyl iodide, isopropyl iodide, and butyl iodide, wherein iodine generated by the decomposition of the alkyl iodide reacts with the stabilizing material.

5. A method for purifying an alkyl iodide, comprising the steps of:

storing the alkyl iodide in a storage container comprising a siphon tube extending into said container, a stabilizing material wrapped around said siphon tube, said stabilizing material having a contact surface for a liquid phase of the alkyl iodide and a contact surface for a gas phase of the alkyl iodide, wherein the stabilizing material is at least one member selected from the group consisting of metallic copper, metallic silver, an alloy of copper and silver, and a complex metal of copper and silver and wherein the alkyl iodide is at least one member selected from the group consisting of methyl iodide, ethyl iodide, propyl iodide, isopropyl iodide, and butyl iodide, wherein iodine generated by the decomposition of the alkyl iodide reacts with the stabilizing material.

6. A method for purifying an alkyl iodide, comprising the steps of:

storing the alkyl iodide in a storage container comprising a ball of a synthetic resin coated with a stabilizing material, said ball being adapted to float on a liquid phase of said alkyl iodide, said ball having a contact surface adapted for contacting a liquid phase of the alkyl iodide and a contact surface for a gas phase of the alkyl iodide, said ball being formed of a stabilizing material wherein the stabilizing material is at least one member selected from the group consisting of metallic copper, metallic silver, an alloy of copper and silver, and a complex metal of copper and silver and wherein the alkyl iodide is at least one member selected from the group consisting of methyl iodide, ethyl iodide, propyl iodide, isopronyl iodide, and butyl iodide, wherein iodine generated by the decomposition of the alkyl iodide reacts with the stabilizing material.

* * * * *